United States Patent [19]

Roux

[11] Patent Number: 4,658,551

[45] **Date of Patent: * Apr. 21, 1987**

[54] CAISSON OF A STACK OF CAISSONS CONSTITUTING THE LATERAL WALLS OF AN UNDERGROUND ROOM SUCH AS PARTICULARLY A CELLAR

[76] Inventor: Paul M. M. Roux, 30 rue de Damiette, 91190 Gif sur Yvette, France

[ * ] Notice: The portion of the term of this patent subsequent to Aug. 26, 2003 has been disclaimed.

[21] Appl. No.: 725,308

[22] Filed: Apr. 19, 1985

[30] Foreign Application Priority Data

Apr. 24, 1984 [FR] France ..... 84 06418

[51] Int. Cl.[4] ..... E04H 1/00

[52] U.S. Cl. ..... 52/79.1; 52/169.6; 52/266; 52/250

[58] Field of Search ..... 52/79.1, 169.6, 266, 52/250; 405/133

[56] References Cited

U.S. PATENT DOCUMENTS 3,263,378 8/1966 Dorris ..... 52/169.6 X
3,490,186 1/1970 Hammond ..... 52/250 X

FOREIGN PATENT DOCUMENTS 1817765 11/1970 Fed. Rep. of Germany ..... 52/79.1
414427 7/1946 Italy ..... 52/79.1

*Primary Examiner*—Carl D. Friedman
*Attorney, Agent, or Firm*—Steinberg & Raskin

[57] ABSTRACT

The present invention relates to a caisson structure intended to form part of a stack of such caissons constituting the lateral walls of an undergound room such as particularly a cellar, wherein each caisson is constituted by modular elements including at least one portion with vertical walls in U arrangement and a portion constituting the top wall of the caisson and nestable into the U-shaped portion.

6 Claims, 5 Drawing Figures

CAISSON OF A STACK OF CAISSONS CONSTITUTING THE LATERAL WALLS OF AN UNDERGROUND ROOM SUCH AS PARTICULARLY A CELLAR

BACKGROUND OF THE INVENTION

The present invention has for a subject matter a caisson or like box-shaped building element of at least one stack of such caissons constituting the lateral walls of an underground or buried room or like enclosed space, such as particularly a cellar or the like.

There is known a process for providing an underground room, such as particularly a cellar, in a structure including a floor slab, particularly of concrete, by which it rests upon the ground. The process includes particularly the operations consisting in cutting an opening in the said slabs and digging an excavation therethrough, in providing a bed, particularly a sand-based bed, and then a floor, lateral walls constituted particularly by stacked, preferably prefabricated caissons or like box-shaped building elements, particularly of concrete, and forming storage compartments, and a ceiling. After providing the floor, there are erected posts or uprights, particularly of reinforced concrete, extending from the floor to the level of the ceiling, and the structural elements of the walls, particularly the said caissons, are inserted by sliding and stacked between the said posts serving as sliding and retaining guides.

The caissons, fulfilling the function of retaining walls for containing the earth pressure by bearing against the said posts are particularly substantially paralellepipedic in shape and are open, either entirely or partially, at least at their bottom and on their internal vertical lateral side, i.e. the side opening towards the internal free space of the room.

However, the making of such caissons by moulding is relatively expensive, since it is necessary to use at least two different moulds, one for making the lowest caissons constituting the base of the room walls and having no upper wall, and the other for making straight caissons other than those of the said wall base, having no bottom and having an upper face fulfilling the function of a bottom for the next upper caisson.

Moreover, the structure of the known caissons does not allow providing compartments with different predetermined storage spaces. It would be necessary, to this end, to provide as many moulds as there are different caissons, thus considerably increasing their manufacturing cost.

SUMMARY OF THE INVENTION

The present invention has for a purpose to remove the above drawbacks.

To this end, the present invention provides a caisson or like box-shaped building element for use in a stack of such caissons, paticularly prefabricated from concrete, fulfilling the function of retaining walls for containing the earth pressure by bearing against posts or uprights extending from the floor to the level of the ceiling of an underground or buried room or like enclosed space, such as particularly a cellar, said caisson being particularly of substantially rectangle paralellepipedic shape, being open, either entirely or partially, at least at its bottom side and its internal vertical lateral side, the said caisson being characterized in that it is constituted by modular elements including at least one portion with vertical walls in right angle U arrangement with respect to one another and having a downwardly flaring internal peripheral surface, and a top wall portion adapted to be nested or fitted in the said U-shaped portion.

According to another feature of the invention, the said caisson includes a second portion with vertical walls in U arrangement, identical with the first aforementioned U-shaped portion, the latter being superposed on the said second portion.

According to still another feature of the invention the said top wall portion is in the form of a cover with an edge of a shape mating, in the region of the bearing surface of the cover, to the U-shape of the said first portion.

BRIEF DESCRIPTION OF THE DRAWINGS

For a fuller understanding of the invention, reference is made to the following description, taken in connection with the accompanying drawings, in which.

DESCRIPTION OF THE PREFERRED EMBODIMENT

Figure 1:
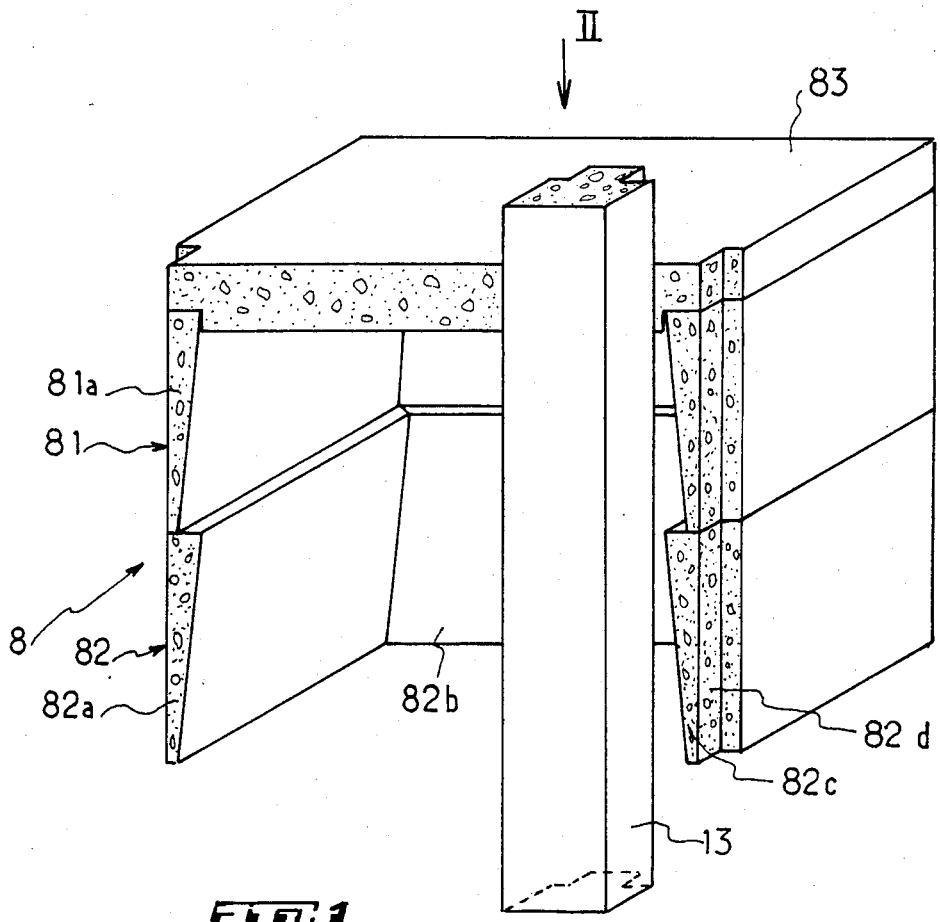
FIG. 1 is a perspective view of a caisson according to the addition.
Figure 2:
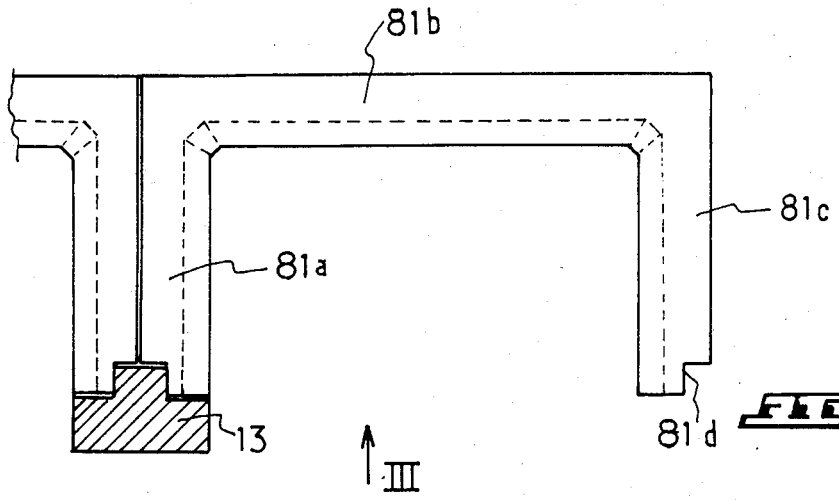
FIG. 2 is a top, partially sectional, view in the direction of arrow II of FIG. 1, the portion forming the top wall of the caisson being removed.

The caisson or like box-shaped building element 8 represented in FIG. 1 forms part of a stack of such caissons which, as described in the main patent, fulfils the function of retaining walls for containing the earth pressure by bearing against the posts or uprights 13, particularly of reinforced concrete, extending from the floor to the level of the ceiling of the underground or buried room or like enclosed space (not shown), such as particularly a cellar.

The caisson 8, which is substantially rectangle paralellepipedic in shape and is open, either entirely or partially, at least on its bottom side and its internal vertical lateral side, is constituted by modular elements including a portion 81 with vertical walls 81*a*, 81*b* and 81*c* in right-angled U arrangement, another portion 82 with vertical walls 82*a*, 82*b* and 82*c* in right-angled U arrangement of an identical structure to that of portion 81. As shown, the portion 81 is superposed on the portion 82 by the walls 81*a*, 81*b*, 81*c* resting on the walls 82*a*, 82*b*,82*c*, respectively, of the portion 82.

Each of the U-shaped portions 81,82 has a downwardly flaring internal peripheral surface corresponding to the draft necessary to allow the withdrawal of the moulding from the mould during its manufacture and constituted by the internal faces of the internal vertical walls 81*a*,81*b*,81*c*; 82*a*,82*b*,82*c*. Otherwise stated, each internal face of the vertical walls of each of the portions 81,82 is inclined with respect to its vertical external face at an angle corresponding to the draft angle. In the caisson configuration represented in FIG. 1, it is seen that the lower edges of smaller width of the walls 81*a*,81*b*,81*c* rest upon the upper edges of greater width of the walls 82*a*,82*b*,82*c*.

Figure 4:
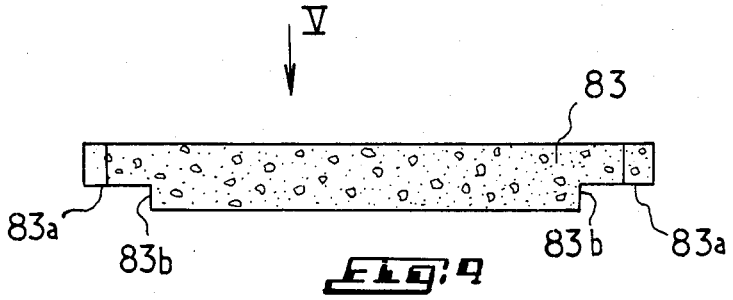
FIG. 4 is a front view, corresponding to FIG. 1, of the portion forming the top wall of the caisson.
Figure 5:
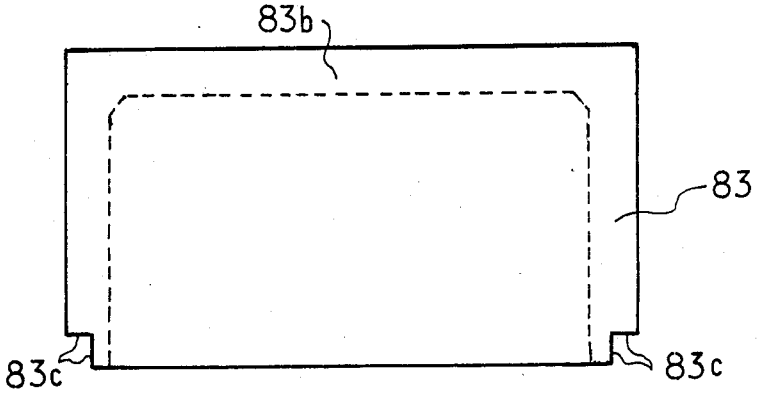
FIG. 5 is a top view in the direction of arrow V of FIG. 4.
Figure 3:
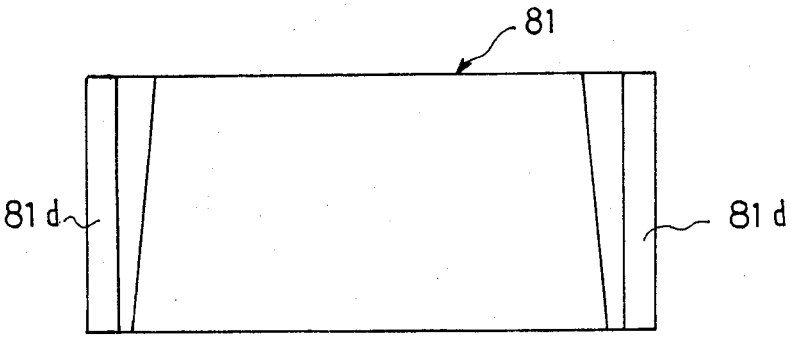
FIG. 3 is a front view in the direction of arrow III of FIG. 2 of a modular element of the caisson, the post used as a slide guide being removed.

The caisson 8 also includes a portion 83 constituting the upper side of the caisson and which is in the form of a cover nestable or adapted to fit into the U-shaped portion 81. As illustrated in FIGS. 4 and 5, the cover portion 83 has a U-shaped horizontal peripheral edge 83*a* bearing upon the upper edges of greater width of the portion 81 and an internal edge 83*b* connecting with the edge 83*a* and of a mating shape to the U-shape of the portion 83 at its top surface or edge of greater width on which the portion 83 bears.

Furthermore, the vertical edges 81*d;* 82*d* of the walls 81*a,* 81*c;* 82*a,*82*c* of the respective branches of the U-shaped portions 81; 82 and the vertical edges 83*c,* formed at the two opposite corners located on the same length of the cover portion 83, are aligned when the modular elements 81, 82 and 83 are assembled and bear against the posts 13, the vertical edges 81*d,*82*d* and 83*c* having a mating shape to that of the said posts.

Of course, the present invention is not limited to the form of embodiment of a caisson including the two modular elements 81 and 82. Other modular elements of an identical shape with that of the elements 81,82 may be superposed on one another so as to define a storage, stowage or like space of a desired height.

Furthermore, the making of the modular elements 81 and 82 of each caisson 8 may be performed continuously instead of being deferred as was the case with the former mould shape, investment expenditure for moulds is therefore very limited and the production rate is very markedly increased, thus considerably reducing the unit manufacturing cost.

What is claimed is:

1. An underground room such as a cellar including a floor, a ceiling, lateral walls formed by stacked box-shaped building elements or caissons prefabricated from concrete and serving as storage bins, and vertical posts extending from said floor to the level of the ceiling, such caissons bearing against said vertical posts for withstanding earth pressure, each caisson having a substantially rectangle parallelepipedic shape and being open, either entirely or partially, on at least its bottom side and an internal vertical lateral side thereof, wherein each caisson is constituted by modular elements including at least one portion with vertical walls in right-angled U arrangement with an inclined internal peripheral surface, and a portion constituting the top wall of the caisson adapted to be nested into said portion in U arrangement.

2. An underground room according to claim 1, comprising at least a second portion with vertical walls in U arrangement identical with said first portion in U arrangement which is superposed on said second portion.

3. An underground room according to claim 2, wherein the vertical edges of the walls constituting branches of said portions and the vertical edges of the cover portion are aligned to bear against said posts and are of a mating shape to that of said posts.

4. An underground room according to claim 1, wherein said nestable portion is in the form of a cover having an internal edge of a mating shape to the U shape of said portion at its surface supporting said cover.

5. An underground room such as a cellar including a floor, a ceiling, lateral walls formed by stacked box-shaped building elements or caissons prefabricated from concrete and serving as storage bins, and vertical posts extending from said floor to the level of the ceiling, said caissons bearing against said vertical posts for withstanding earth pressure, each caisson having a substantially rectangle parallelepipedic shape and being open, either entirely or partially, on at least its bottom side and an internal vertical lateral side, wherein each caisson is constituted by modular elements including at least one portion with vertical walls in right-angled U arrangement with an inclined internal peripheral surface, and a portion in the form of a cover constituting the top wall of the caisson and having an internal edge of a mating shape to the U shape of said portion at its surface supporting said cover so that the latter is nestable into said portion in U arrangement.

6. An underground room such as a cellar including a floor, a ceiling, lateral walls formed by stacked box-shaped building elements or caissons prefabricated from concrete and serving as storage bins, and vertical posts extending from said floor to the level of the ceiling, said caissons bearing against said vertical posts for withstanding earth pressure, each caisson having a substantially rectangle parallelepipedic shape and being open, either entirely or partially, on at least its bottom side and an internal vertical lateral side, wherein each caisson is constituted by modular elements including identical first and second portions with vertical walls in right-angled U arrangement with an inclined internal peripheral surface, with the first portion superposed on the second portion, and a portion in the form of a cover constituting the top wall of the caisson and having an internal edge of a mating shape to the U shape of the first portion at its surface supporting said cover so that the latter is nestable into said first portion.

* * * * *